US009429081B2

(12) United States Patent
Moscherosch et al.

(10) Patent No.: US 9,429,081 B2
(45) Date of Patent: Aug. 30, 2016

(54) CYLINDER RE-ACTIVATION FUELING CONTROL SYSTEMS AND METHODS

(71) Applicant: GM Global Technology Operations LLC, Detroit, MI (US)

(72) Inventors: Ben W. Moscherosch, Waterford, MI (US); Hector Arvizu Dal Piaz, Oakland Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 218 days.

(21) Appl. No.: 14/261,483

(22) Filed: Apr. 25, 2014

(65) Prior Publication Data

US 2015/0308355 A1 Oct. 29, 2015

(51) Int. Cl.
*F02D 17/02* (2006.01)

(52) U.S. Cl.
CPC ..... *F02D 17/02* (2013.01)

(58) Field of Classification Search
CPC . F01L 13/005; F01L 2013/001; F02D 17/02; F02D 13/06; F02D 41/0087
USPC ..... 123/198 F, 481, 90.15, 672
See application file for complete search history.

(56) References Cited

U.S. PATENT DOCUMENTS

2015/0252743 A1* 9/2015 Glugla ..... F02D 41/1498 701/104
2015/0345407 A1* 12/2015 Glugla ..... F02D 17/02 123/403

* cited by examiner

*Primary Examiner* — Hai Huynh

(57) ABSTRACT

An engine control system is described. A cylinder control module selectively activates and deactivates intake and exhaust valves of a cylinder of an engine. A fuel control module disables fueling of the cylinder when the intake and exhaust valves of the cylinder are deactivated and, when the intake and exhaust valves of the cylinder are activated after being deactivated for at least one combustion cycle of the cylinder, adjusts fueling of the cylinder based on a predetermined reactivation fueling adjustment set for the cylinder.

20 Claims, 7 Drawing Sheets

CYLINDER RE-ACTIVATION FUELING CONTROL SYSTEMS AND METHODS

FIELD

The present disclosure relates to internal combustion engines and more particularly to fuel control systems and methods.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. In some types of engines, air flow into the engine may be regulated via a throttle. The throttle may adjust throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

Under some circumstances, one or more cylinders of an engine may be deactivated. Deactivation of a cylinder may include deactivating opening and closing of intake valves of the cylinder and halting fueling of the cylinder. One or more cylinders may be deactivated, for example, to decrease fuel consumption when the engine can produce a requested amount of torque while the one or more cylinders are deactivated.

SUMMARY

In a feature, an engine control system is described. A cylinder control module selectively activates and deactivates intake and exhaust valves of a cylinder of an engine. A fuel control module disables fueling of the cylinder when the intake and exhaust valves of the cylinder are deactivated and, when the intake and exhaust valves of the cylinder are activated after being deactivated for at least one combustion cycle of the cylinder, adjusts fueling of the cylinder based on a predetermined reactivation fueling adjustment set for the cylinder.

In further features, the fuel control module: determines a first target equivalence ratio for the cylinder; when the intake and exhaust valves of the cylinder are activated after being deactivated for at least one combustion cycle of the cylinder, generates a second target equivalence ratio for the cylinder based on the first target equivalence ratio and the predetermined reactivation fueling adjustment set for the cylinder; and fuels the cylinder based on the second target equivalence ratio.

In still further features, when the intake and exhaust valves are activated after being activated for at least one combustion cycle of the cylinder, the fuel control module sets the second target equivalence ratio for the cylinder equal to the first target equivalence ratio.

In yet further features, a fueling adjustment determination system includes: the engine control system; and an adjustment determination module. The adjustment determination module: after a first deactivation of the intake and exhaust valves of the cylinder for at least one combustion cycle of the cylinder, activates the intake and exhaust valves of the cylinder; adjusts fueling of the cylinder based on a first predetermined value; determines a first amount of at least one constituent of exhaust resulting from the adjustment based on the first predetermined value; after a second deactivation of the intake and exhaust valves of the cylinder for at least one combustion cycle of the cylinder, activates the intake and exhaust valves of the cylinder; adjusts fueling of the cylinder based on a second predetermined value; determines a second amount of the at least one constituent of exhaust resulting from the adjustment based on the second predetermined value; and sets the predetermined reactivation fueling adjustment for the cylinder based on one of the first and second predetermined values.

In further features, the adjustment determination module further: selects the one of the first and second predetermined values based on the first and second amounts of the at least one constituent of the exhaust; and sets the predetermined reactivation fueling adjustment for the cylinder based on the selected one of the first and second predetermined values.

In yet further features, the at least one constituent of the exhaust includes carbon dioxide, and the adjustment determination module selects the first predetermined value when the first amount is greater than the second amount.

In still further features, the adjustment determination module selects the second predetermined value when the second amount is greater than the first amount.

In yet further features, the at least one constituent of the exhaust includes carbon monoxide and oxygen, and the adjustment determination module selects the first predetermined value when the first amount is less than the second amount.

In further features, the adjustment determination module selects the second predetermined value when the second amount is less than the first amount.

In still further features, the adjustment determination module further: after a third deactivation of the intake and exhaust valves of the cylinder for at least one combustion cycle of the cylinder, activates the intake and exhaust valves of the cylinder; adjusts fueling of the cylinder based on a third predetermined value; determines a third amount of the at least one constituent of exhaust resulting from the adjustment based on the third predetermined value; selects the one of the first, second, and third predetermined values based on the first, second, and third amounts of the at least one constituent of the exhaust; and sets the predetermined reactivation fueling adjustment for the cylinder based on the selected one of the first, second, and third predetermined values.

In a feature, an engine control method includes: selectively activating and deactivating intake and exhaust valves of a cylinder of an engine; disabling fueling of the cylinder when the intake and exhaust valves of the cylinder are deactivated; activating the intake and exhaust valves of the cylinder after the intake and exhaust valves are deactivated for at least one combustion cycle of the cylinder; when the intake and exhaust valves of the cylinder are activated after being deactivated for the at least one combustion cycle of the cylinder, adjusting fueling of the cylinder based on a predetermined reactivation fueling adjustment set for the cylinder.

In further features, the engine control method further includes: determining a first target equivalence ratio for the cylinder; when the intake and exhaust valves of the cylinder are activated after being deactivated for the at least one combustion cycle of the cylinder, generating a second target equivalence ratio for the cylinder based on the first target equivalence ratio and the predetermined reactivation fueling adjustment set for the cylinder; and fueling the cylinder based on the second target equivalence ratio.

In still further features, the engine control method further includes, when the intake and exhaust valves are activated after being activated for the at least one combustion cycle of the cylinder, setting the second target equivalence ratio for the cylinder equal to the first target equivalence ratio.

In yet further features, the engine control method further includes after a first deactivation of the intake and exhaust valves of the cylinder for at least one combustion cycle of the cylinder, activating the intake and exhaust valves of the cylinder; adjusting fueling of the cylinder based on a first predetermined value; determining a first amount of at least one constituent of exhaust resulting from the adjustment based on the first predetermined value; after a second deactivation of the intake and exhaust valves of the cylinder for at least one combustion cycle of the cylinder, activating the intake and exhaust valves of the cylinder; adjusting fueling of the cylinder based on a second predetermined value; determining a second amount of the at least one constituent of exhaust resulting from the adjustment based on the second predetermined value; and setting the predetermined reactivation fueling adjustment for the cylinder based on one of the first and second predetermined values.

In further features, the engine control method further includes: selecting the one of the first and second predetermined values based on the first and second amounts of the at least one constituent of the exhaust; and setting the predetermined reactivation fueling adjustment for the cylinder based on the selected one of the first and second predetermined values.

In yet further features, the at least one constituent of the exhaust includes carbon dioxide, and the engine control method further includes: selecting the first predetermined value when the first amount is greater than the second amount.

In still further features, the engine control method further includes selecting the second predetermined value when the second amount is greater than the first amount.

In further features, the at least one constituent of the exhaust includes carbon monoxide and oxygen, and the engine control method further includes: selecting the first predetermined value when the first amount is less than the second amount.

In still further features, the engine control method further includes selecting the second predetermined value when the second amount is less than the first amount.

In yet further features, the engine control method further includes: after a third deactivation of the intake and exhaust valves of the cylinder for at least one combustion cycle of the cylinder, activating the intake and exhaust valves of the cylinder; adjusting fueling of the cylinder based on a third predetermined value; determining a third amount of the at least one constituent of exhaust resulting from the adjustment based on the third predetermined value; selecting the one of the first, second, and third predetermined values based on the first, second, and third amounts of the at least one constituent of the exhaust; and setting the predetermined reactivation fueling adjustment for the cylinder based on the selected one of the first, second, and third predetermined values.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Internal combustion engines combust an air and fuel mixture within cylinders to generate torque. Under some circumstances, an engine control module (ECM) may deactivate one or more cylinders of the engine. The ECM may deactivate one or more cylinders, for example, to decrease fuel consumption when the engine can produce a requested amount of torque while the one or more cylinders are deactivated. Deactivation of a cylinder may include deactivating opening and closing of intake valves of the cylinder and halting fueling of the cylinder.

Walls of a cylinder cool when the cylinder is deactivated for one or more combustion cycles. An air charge within the cylinder for a first combustion cycle after the deactivation may therefore be cooler and denser than air charges of cylinders that were previously activated. Additionally, airflow into the cylinder for the first combustion cycle after the deactivation may be different than airflow into other cylinders and may be different than airflow into the cylinder if the cylinder was previously activated. Fueling of the cylinder when the cylinder is re-activated may therefore be adjusted to achieve a target air/fuel mixture and to minimize exhaust emissions.

According to the present disclosure, during vehicle/engine design, different fuel adjustments are used to control fueling of a cylinder each time that the cylinder is re-activated. The resulting exhaust is monitored. A fueling adjustment is determined for the cylinder based on one or more components of the exhaust resulting from the different fuel adjustments. For example, carbon dioxide, carbon monoxide, and/or oxygen may be monitored, and the fueling adjustment providing a maximum amount of carbon dioxide and/or a minimum amount of carbon monoxide and oxygen may be selected. During operation of the engine, when the cylinder is re-activated after being deactivated for one or more combustion cycles, the ECM adjusts fueling of the cylinder based on the fueling adjustment determined for the cylinder.

Figure 1:
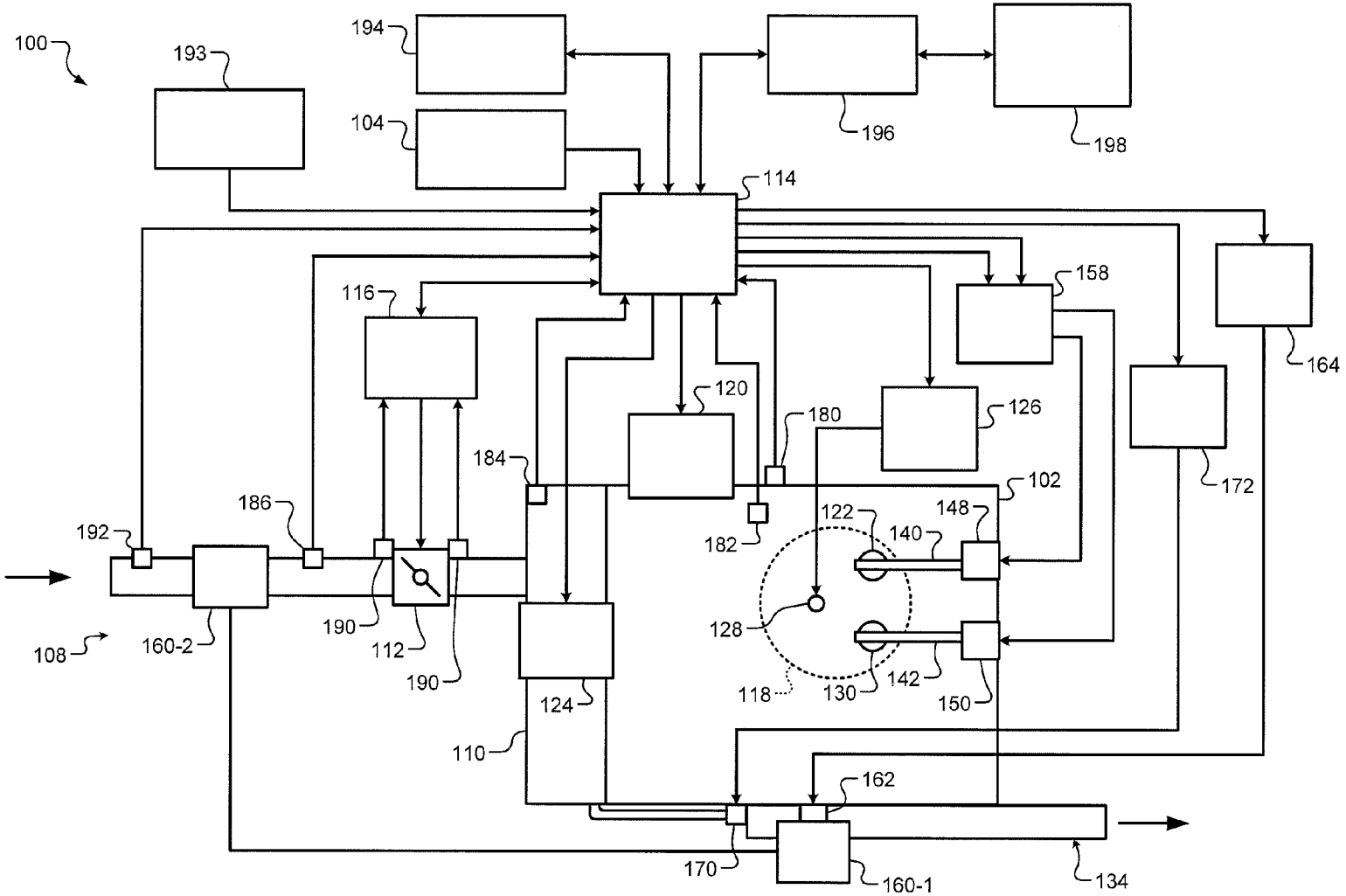
FIG. 1 is a functional block diagram of an example engine system.

Referring now to FIG. 1, a functional block diagram of an example engine system 100 is presented. The engine system 100 of a vehicle includes an engine 102 that combusts an air/fuel mixture to produce torque based on driver input from a driver input module 104. Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate one or more of the cylinders under some circumstances, as discussed further below, which may improve fuel efficiency.

The engine 102 may operate using a four-stroke combustion cycle. The four strokes, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes. While the example of a four-stroke engine is provided, the present application is also applicable to engines operating using other types of engine cycles.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a target air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may halt provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time at which the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft based valve actuation is shown and has been discussed, camless valve actuators may be implemented.

The cylinder actuator module 120 may deactivate the cylinder 118 by disabling opening of the intake valve 122 and/or the exhaust valve 130. The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than camshafts, such as electromechanical actuators, electrohydraulic actuators, electromagnetic actuators, etc.

The engine system 100 may include one or more boost devices that provide pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The engine 102 outputs torque to a transmission (not shown) via the crankshaft. One or more coupling devices, such as a torque converter and/or one or more clutches, regulate torque transfer between a transmission input shaft and the crankshaft. Torque is transferred between the transmission input shaft and a transmission output shaft via the gears.

The ECM 114 may communicate with a hybrid control module 196 to coordinate operation of the engine 102 and an electric motor 198. The electric motor 198 may also function as a generator, and may be used to produce electrical energy for use by vehicle electrical systems and/or for storage in a battery. While only the electric motor 198 is shown and discussed, multiple electric motors may be implemented. In various implementations, various functions of the ECM 114, the transmission control module 194, and the hybrid control module 196 may be integrated into one or more modules.

Figure 2:
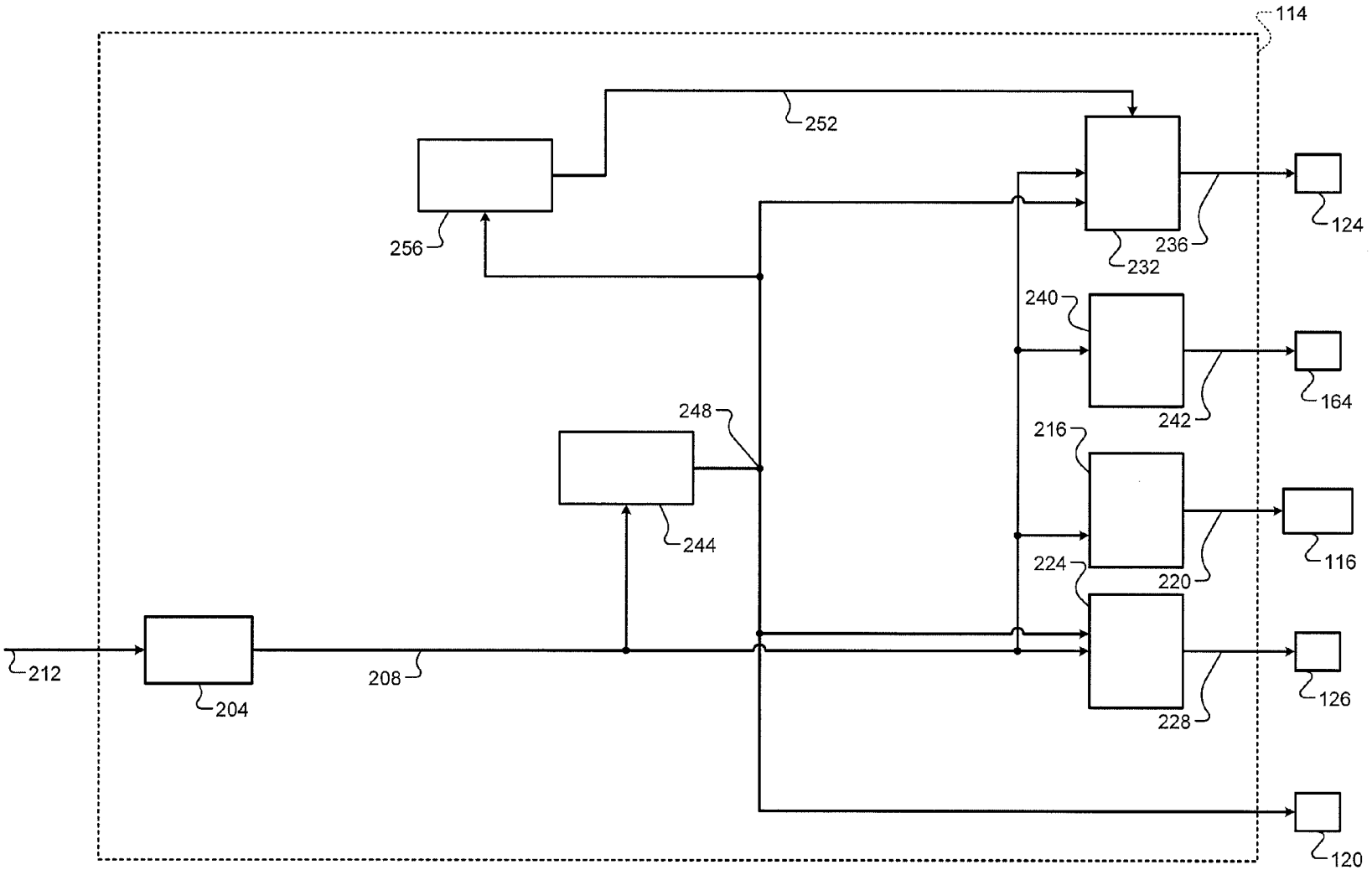
FIG. 2 is a functional block diagram of an example engine control system.

Referring now to FIG. 2, a functional block diagram of an example engine control system is presented. A torque request module 204 may determine a torque request 208 based on one or more driver inputs 212, such as an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 114 and/or torque requests received from other modules of the vehicle, such as the transmission control module 194, the hybrid control module 196, a chassis control module, etc.

One or more engine actuators may be controlled based on the torque request 208. For example, a throttle control module 216 determines a target throttle opening 220 based on the torque request 208. The throttle actuator module 116 controls opening of the throttle valve 112 based on the target throttle opening 220. A spark control module 224 may determine a target spark timing 228 based on the torque request 208. The spark actuator module 126 may generate spark based on the target spark timing 228.

A fuel control module 232 determines one or more target fueling parameters 236 based on the torque request 208 and/or one or more other parameters. The fuel actuator module 124 injects fuel based on the target fueling parameters 236. A boost control module 240 may determine a target boost 242 based on the torque request 208. The boost actuator module 164 may control boost output by the boost device(s) based on the target boost 242.

Additionally, a cylinder control module 244 determines a target cylinder activation/deactivation command 248 based on the torque request 208. For example only, the cylinder control module 244 may determine the target cylinder activation/deactivation command 248 based on the number of cylinders that should be activated to achieve the torque request 208. The cylinder actuator module 120 deactivates the intake and exhaust valves of cylinders that are to be deactivated according to the target cylinder activation/deactivation command 248. The cylinder actuator module 120 allows opening and closing of the intake and exhaust valves of cylinders that are to be activated according to the target cylinder activation/deactivation command 248.

Fueling is disabled to cylinders that are to be deactivated according to the target cylinder activation/deactivation command 248, and fuel is provided the cylinders that are to be activated according to the target cylinder activation/deactivation command 248. Spark is provided to the cylinders that are to be activated according to the target cylinder activation/deactivation command 248. Spark may be provided or disabled to cylinders that are to be deactivated according to the target cylinder activation/deactivation command 248. Cylinder deactivation is different than fuel cutoff (e.g., deceleration fuel cutoff) in that the intake and exhaust valves of cylinders to which fueling is disabled during fuel cutoff are still opened and closed during the fuel cutoff whereas the intake and exhaust valves remain closed when deactivated.

Referring back to the fuel control module 232, the fuel control module 232 may determine a target equivalence ratio for a combustion cycle of a cylinder to be addressed in a predetermined firing order of the cylinders. When that cylinder is to be deactivated according to the target cylinder activation/deactivation command 248, the fuel control module 232 may set the target equivalence ratio for the cylinder to zero.

The fuel control module 232 may adjust the target equivalence ratio for the cylinder based on a reactivation fueling adjustment 252 set for the cylinder. For example only, the fuel control module 232 may multiply the target equivalence ratio by the reactivation fueling adjustment 252 or sum the target equivalence ratio with the reactivation fueling adjustment 252 to produce a final target equivalence ratio for the cylinder. The fuel actuator module 124 controls fueling to the cylinder to achieve the final target equivalence ratio.

An adjustment setting module 256 sets the reactivation fueling adjustment 252 for the cylinder based on whether the cylinder was previously deactivated. For example, when the cylinder was deactivated for its last combustion cycle and is to be activated during the next combustion cycle, the adjustment setting module 256 sets the reactivation fueling adjustment 252 for the cylinder to a predetermined reactivation value set for the cylinder.

One or more predetermined reactivation values are determined and set for each cylinder of the engine 102. Determination of the predetermined reactivation values for the cylinders, respectively, is discussed further below. The predetermined reactivation values are used to adjust the target equivalence ratios determined for the cylinders, respectively, when the cylinders are reactivated after being deactivated for one or more combustion cycles.

The adjustment setting module 256 may set the reactivation fueling adjustment 252 for the cylinder to a predetermined non-adjusting value when the cylinder was activated during its last combustion cycle. The predetermined non-adjusting value is set such that the reactivation fueling adjustment 252 will not adjust the target equivalence ratio when the predetermined non-adjusting value is used. The predetermined non-adjusting value may be, for example, zero in implementations where the reactivation fueling adjustment 252 is summed with the target equivalence ratio and one in implementations where the reactivation fueling adjustment 252 is multiplied with the target equivalence ratio.

Figure 3:
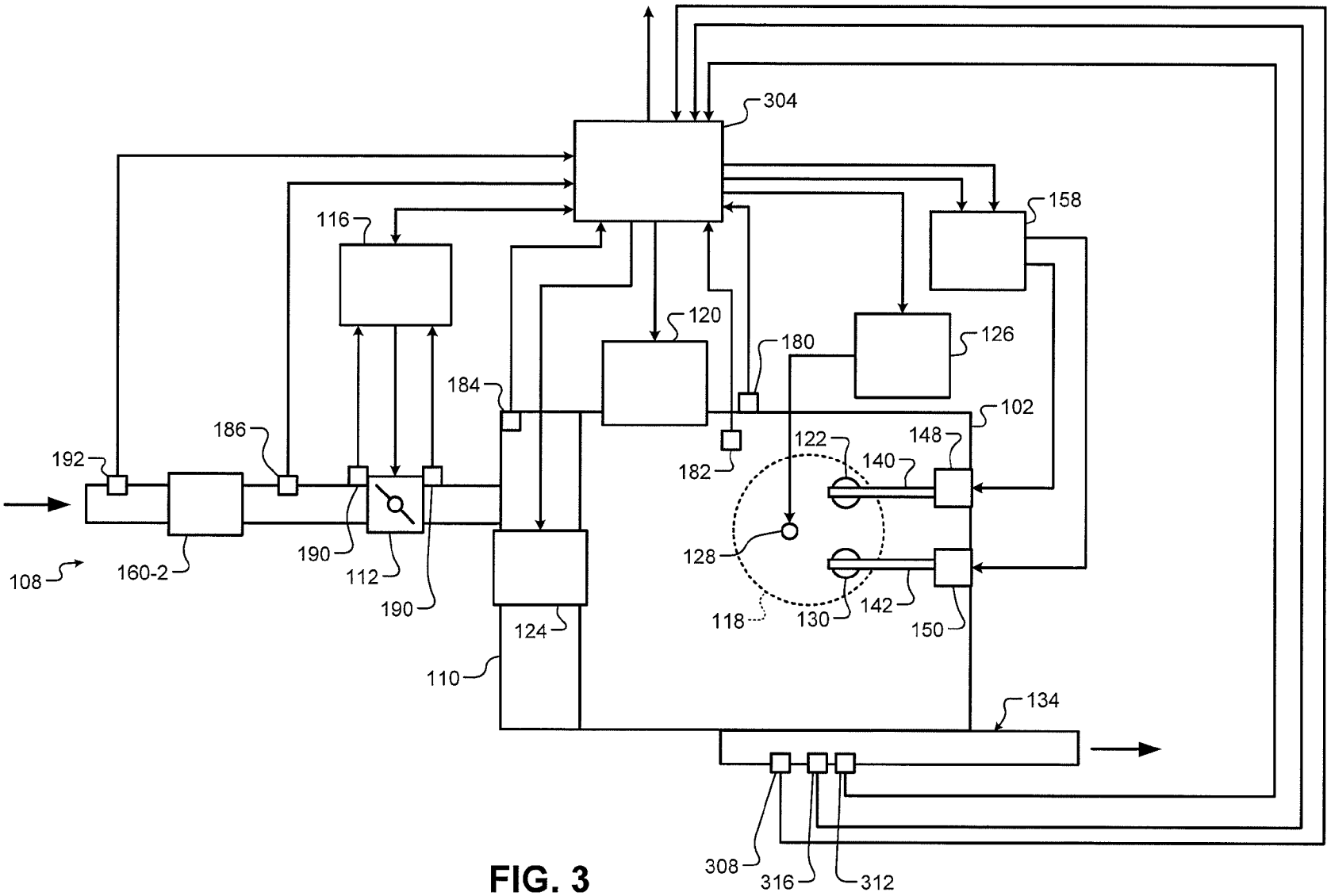
FIG. 3 is a functional block diagram of an example reactivation fueling adjustment determination system.

Referring now to FIG. 3, a functional block diagram of an example reactivation fueling adjustment determination system is presented. An adjustment determination module 304 determines the predetermined reactivation value for the cylinder 118 and the predetermined reactivation values for the other cylinders, respectively. While only the determination of the predetermined reactivation value for the cylinder 118 will be discussed, the adjustment determination module 304 may determine the predetermined reactivation value for the other cylinders, respectively, similarly or identically. The adjustment determination module 304 may, for example, be a component of a dynamometer. One or more components of the engine system 100 may be omitted for the determination of the predetermined reactivation values by the adjustment determination module 304.

The adjustment determination module 304 deactivates the cylinder 118 for at least one combustion cycle. Deactivation of the cylinder 118 includes disabling opening of the intake and exhaust valves 122 and 130 and disabling fueling of the cylinder 118. Deactivation of the cylinder 118 may also include disabling the spark plug 128.

When the cylinder has been deactivated for at least one combustion cycle, the adjustment determination module 304 activates the cylinder 118 for a combustion cycle of the cylinder 118. The adjustment determination module 304 sets the predetermined reactivation value for the combustion cycle to a first one of N possible values for the predetermined reactivation value. N is an integer greater than two. The target equivalence ratio for the combustion cycle is adjusted based on the first one of N possible values to produce the final target equivalence ratio, and fuel is supplied to the cylinder 118 based on the final target equivalence ratio.

A carbon dioxide sensor 308 measures carbon dioxide in exhaust output by the engine 102. A carbon monoxide sensor 312 measures carbon monoxide in exhaust output by the engine 102. An oxygen sensor 316 measures oxygen in exhaust output by the engine 102. In various implementations, a sensor that measures a combined amount of carbon monoxide and oxygen in the exhaust may be implemented. A hydrocarbon (HC) sensor and/or one or more other suitable exhaust sensors may be implemented additionally or alternatively.

The adjustment determination module 304 monitors one or more components of the exhaust resulting from the combustion cycle of the cylinder 118 when the first one of the N possible values was used. The adjustment determination module 304 stores the value of the one or more components of the exhaust. For example, the adjustment determination module 304 may store an amount of carbon dioxide in the resulting exhaust, an amount of oxygen in the resulting exhaust, and/or an amount of carbon monoxide in the resulting exhaust. The adjustment determination module 304 may store the one or more components of the resulting exhaust in association with the first one of the N possible values.

After using the first one of the N possible values, the adjustment determination module 304 deactivates the cylinder 118 for at least one combustion cycle. When the cylinder 118 has been deactivated for at least one combustion cycle, the adjustment determination module 304 activates the cylinder 118 for a combustion cycle of the cylinder 118. The adjustment determination module 304 sets the predetermined reactivation value for this combustion cycle to a second one of N possible values for the predetermined reactivation value. The second one of N possible values is different than the first one of the N possible values. The target equivalence ratio for the combustion cycle is adjusted based on the second one of N possible values to produce the final target equivalence ratio, and fuel is supplied to the cylinder 118 based on the final target equivalence ratio.

The adjustment determination module 304 monitors the one or more components of the exhaust resulting from the combustion cycle of the cylinder 118 when the second one of the N possible values was used. The adjustment determination module 304 also stores the one or more components of the resulting exhaust. The adjustment determination module 304 continues this process of deactivating the cylinder 118 for one or more combustion cycles, selecting a different one of the N possible values, adjusting fueling based on the selected possible value when the cylinder 118 is reactivated, and recording the one or more components of the resulting exhaust until each of the N possible values has been used.

Figure 4:
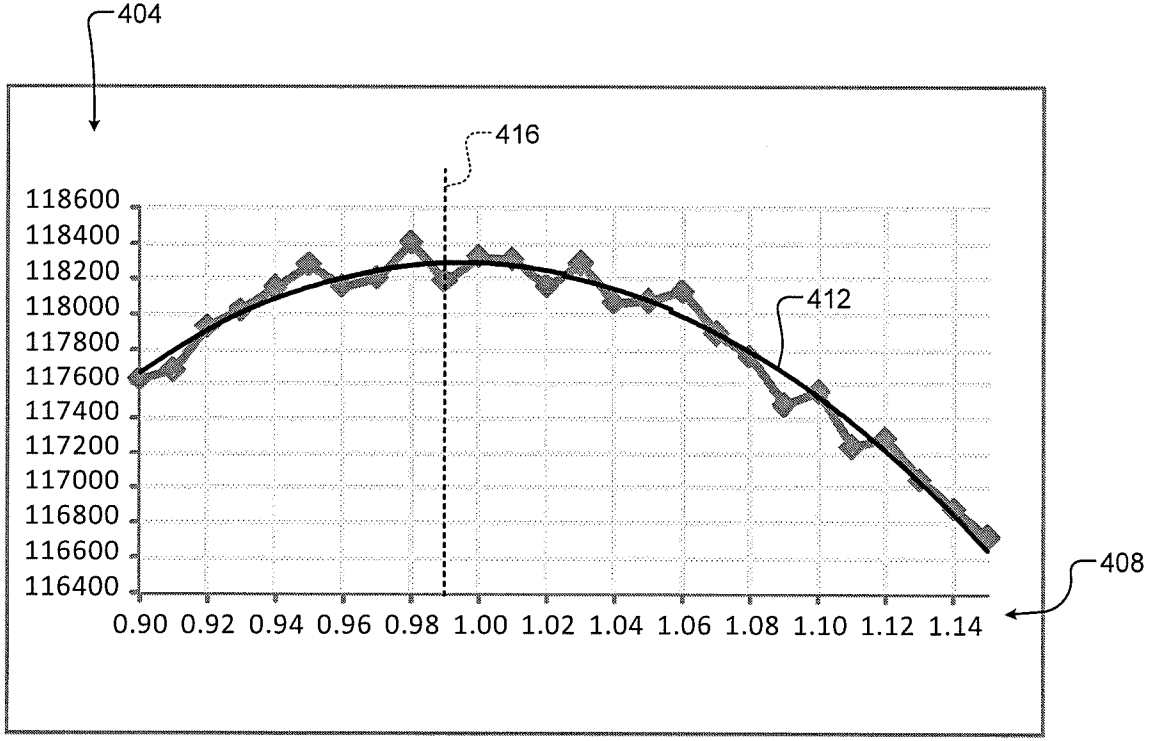
FIG. 4 is an example graph of carbon dioxide in exhaust gas resulting from use of various reactivation fueling adjustments.
Figure 5:
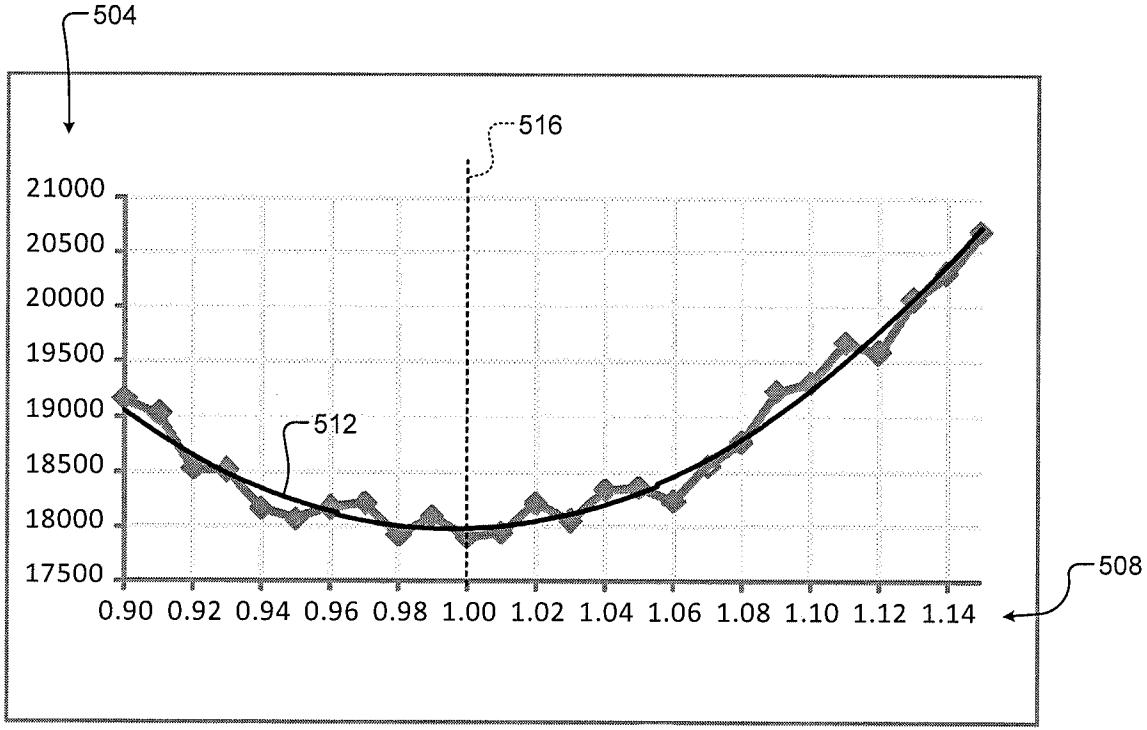
FIG. 5 is an example graph of a combined amount of carbon monoxide and oxygen in exhaust gas resulting from use of various reactivation fueling adjustments.

FIG. 4 includes an example graph of amounts of carbon dioxide 404 in exhaust resulting from the use of a plurality of possible reactivation fueling adjustment values 408. FIG. 5 includes an example graph of combined amounts of carbon monoxide 504 in exhaust resulting from the use of a plurality of possible reactivation fueling adjustment values 508. In the examples of FIGS. 4 and 5, the reactivation fueling adjustment values are for the implementation where the reactivation fueling adjustments are multiplied with the target equivalence ratio. However, other suitable reactivation fueling adjustments may be used.

When the N possible values have been selected and used, the adjustment determination module 304 may fit a curve to the stored values. For example, example curves 412 and 512 are provided in FIGS. 4 and 5 based on the respective stored values. The curve may be, for example, a second, third, fourth, or higher order polynomial curve or another suitable type of curve.

The adjustment determination module 304 determines the predetermined reactivation value for the cylinder 118 based on one or more of the curves. For example, the adjustment determination module 304 may determine the predetermined reactivation value for the cylinder 118 as the one of the possible reactivation fueling adjustment values 408 where the curve 412 reaches a maximum value. This is indicated in the example of FIG. 4 by line 416, and the adjustment determination module 304 may set the predetermined reactivation value for the cylinder 118 to approximately 0.99.

For example another example, the adjustment determination module 304 may determine the predetermined reactivation value for the cylinder 118 as the one of the possible reactivation fueling adjustment values 508 where the curve 512 reaches a minimum value. This is indicated in the example of FIG. 5 by line 516, and set the predetermined reactivation value for the cylinder 118 to approximately 1.00.

The adjustment determination module 304 performs the process above for each cylinder of the engine 102 and determines a respective predetermined reactivation value for each cylinder. The predetermined reactivation values are stored in the ECMs of vehicles having the same engine. During operation of the engine 102 in the vehicle, the ECM 114 adjusts fueling of the cylinders based on the predetermined reactivation values determined for the cylinders when those cylinders are activated after being deactivated for one or more combustion cycles, respectively.

Figure 6:
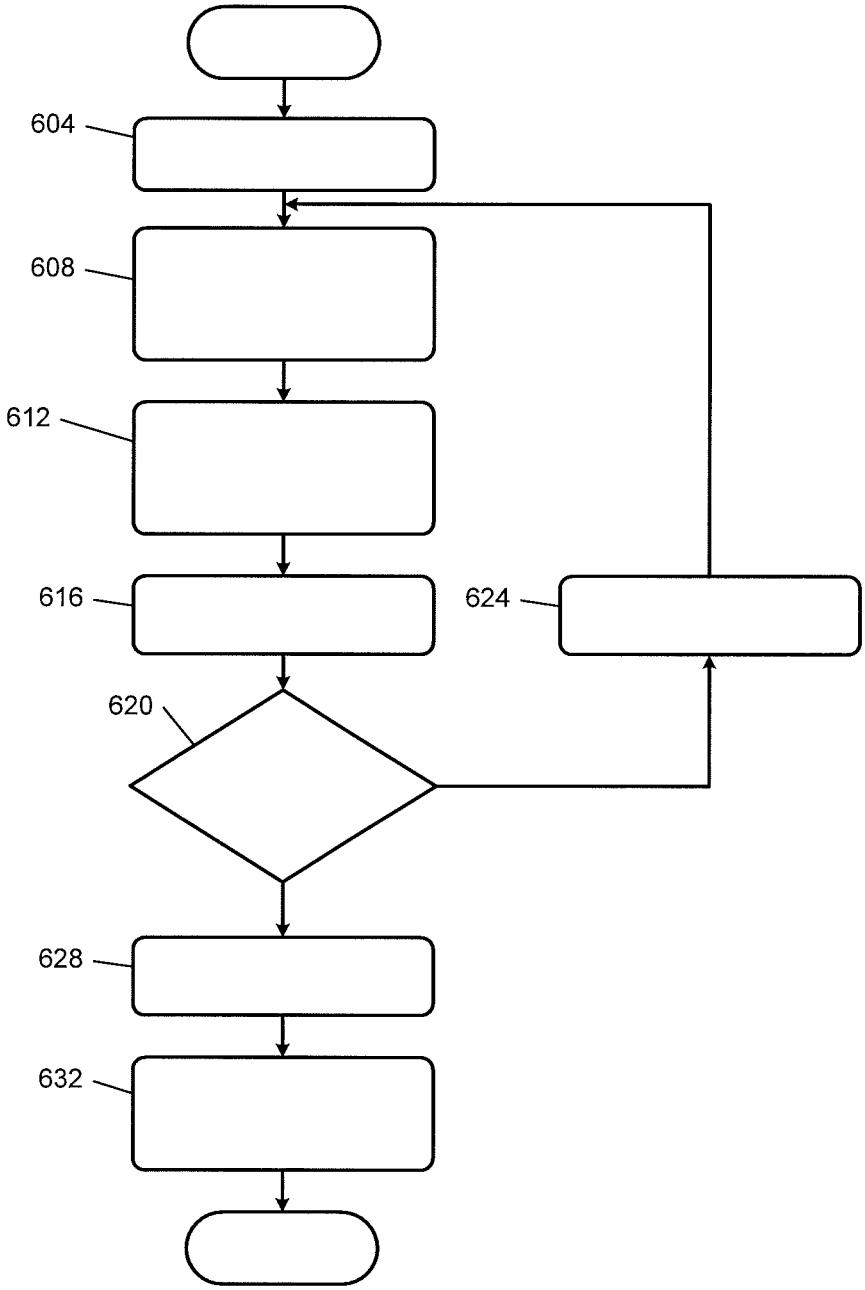
FIG. 6 is a flowchart depicting an example method of determining the reactivation fueling adjustment for a cylinder of an engine.

Referring now to FIG. 6, a flowchart depicting an example method of determining the predetermined reactivation value for a cylinder is presented. Control may begin with 604 where the adjustment determination module 304 sets I=1. At 608, the adjustment determination module 304 deactivates the cylinder for one or more combustion cycles of the cylinder.

At 612, the adjustment determination module 304 determines a target equivalence ratio for a combustion cycle of the cylinder, selects an I-th one of the N possible values for the predetermined reactivation value, and adjusts the target equivalence ratio based on the I-th one of the N possible values to produce the final target equivalence ratio. The adjustment determination module 304 activates the intake and exhaust valves of the cylinder at 612 and provides fuel to the cylinder based on the final target equivalence ratio.

At 616, the adjustment determination module 304 stores the one or more components of the exhaust resulting from the use of the I-th one of the N possible values and the I-th one of the N possible values. At 620, the adjustment determination module 304 determines whether I is equal to N (i.e., the total number of possible values). If 620 is false, the adjustment determination module 304 increments I at 624 (i.e., set I=I+1), and control returns to 608. If 620 is true, control continues with 628. In this manner, control continues with 628 when each of the N possible values has been selected and used.

At 628, the adjustment determination module 304 generates a curve based on the stored values, such as a second-order polynomial curve. The adjustment determination module 304 determines the predetermined reactivation value for the cylinder at 632 based on the curve. For example, the adjustment determination module 304 may set the reactivation fueling adjustment for the cylinder equal to or based on the one of the N possible values where a curve generated based on carbon dioxide values reaches a maximum value. Additionally or alternatively, the adjustment determination module 304 may set the reactivation fueling adjustment for the cylinder equal to or based on the one of the N possible values where a curve generated based on an amount of carbon monoxide and oxygen reaches a minimum value. While the example of FIG. 6 is shown as ending, one or more iterations of FIG. 6 may be performed for each cylinder of an engine to determine the respective reactivation fueling adjustments for the cylinders.

Figure 7:
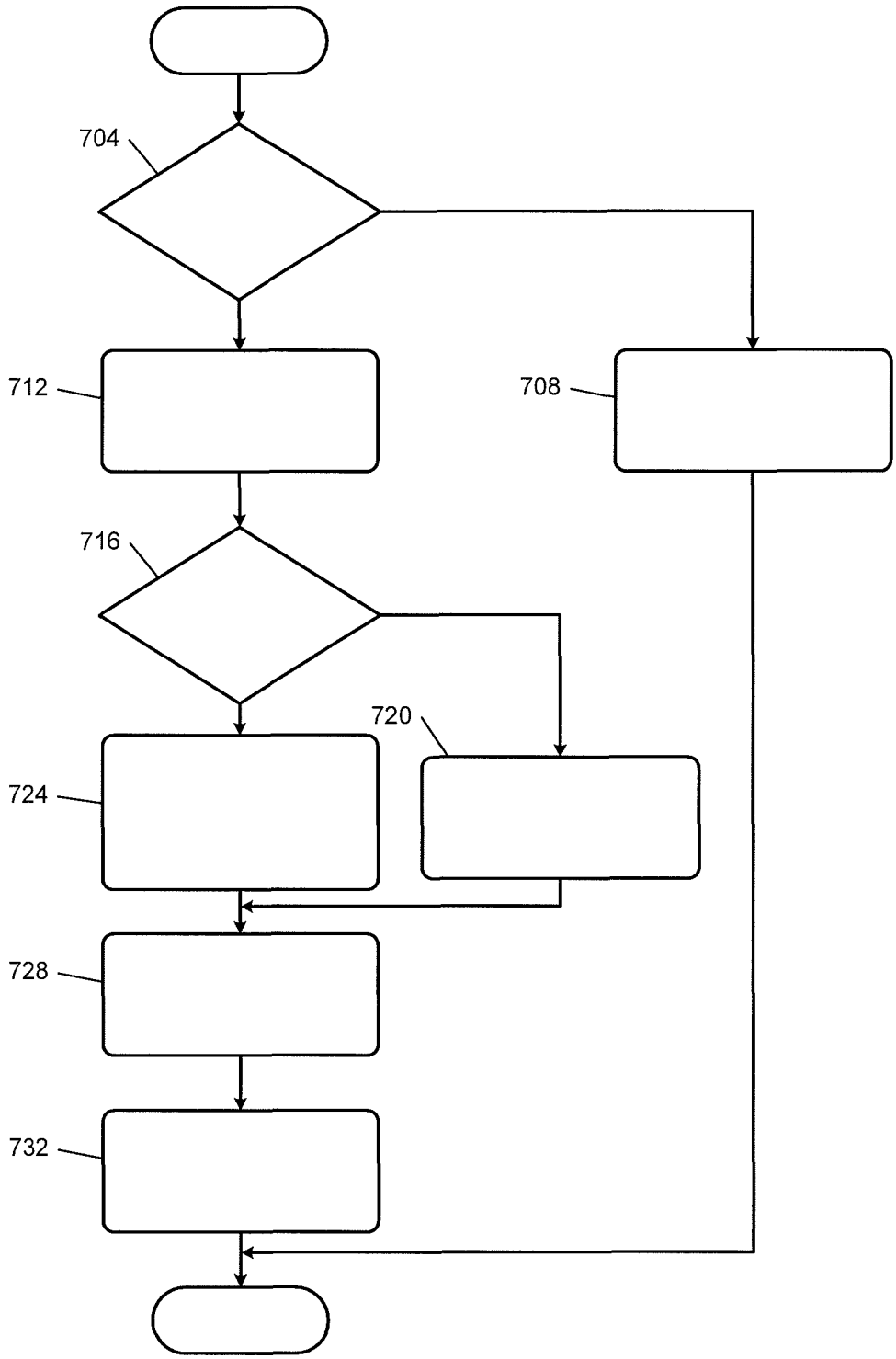
FIG. 7 is a flowchart depicting controlling fueling of the cylinder of the engine based on the reactivation fueling adjustment of the cylinder when the cylinder is activated after being deactivated for one or more combustion cycles.

Referring now to FIG. 7, a flowchart depicting an example method of fueling a cylinder based on the cylinder's reactivation fueling adjustment is presented. At 704, the cylinder control module 244 determines whether the cylinder should be activated for a combustion cycle. If 704 is false, the cylinder actuator module 120 disables opening of the intake and exhaust valves of the cylinder and the fuel control module 232 disables fueling of the cylinder at 708, and control may end. If 704 is true, control continues with 712.

At 712, the fuel control module 232 determines a target equivalence ratio for the combustion cycle of the cylinder. At 716, the adjustment setting module 256 determines whether the cylinder was last deactivated for one or more of its combustion cycles. If 716 is false, the adjustment setting module 256 may set the reactivation fueling adjustment 252 to the predetermined non-adjusting value at 720, and control continues with 728. If 716 is true, the adjustment setting module 256 sets the reactivation fueling adjustment 252 to the predetermined reactivation value determined for the cylinder at 724, and control continues with 728.

The fuel control module 232 adjusts the target equivalence ratio based on the reactivation fueling adjustment 252 at 728 to produce the final target equivalence ratio for the combustion cycle of the cylinder. For example, the fuel control module 232 may multiply or sum the target equivalence ratio with the reactivation fueling adjustment 252 to produce the final target equivalence ratio. At 732, the fuel actuator module 124 provides fuel to the cylinder for the combustion cycle based on the final target equivalence ratio, and control may end. While the example of FIG. 7 has been discussed in terms of a single cylinder, FIG. 7 is performed for each cylinder.

While determining reactivation fueling adjustments for the cylinders, respectively, has been shown and described, the present application is also applicable to determining individual cylinder fueling compensation values for the cylinders for when the cylinders were not previously deactivated based on the resulting exhaust gas. Fueling to a cylinder is controlled based on that cylinder's individual fueling compensation value when that cylinder was previously activated.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. An engine control system, comprising:

a cylinder control module that selectively activates and deactivates intake and exhaust valves of a cylinder of an engine; and a fuel control module that disables fueling of the cylinder when the intake and exhaust valves of the cylinder are deactivated and that, when the intake and exhaust valves of the cylinder are activated after being deactivated for at least one combustion cycle of the cylinder, adjusts fueling of the cylinder based on a predetermined reactivation fueling adjustment set for the cylinder based on at least one constituent of exhaust resulting from the adjustment based on the predetermined fueling adjustment.

2. The engine control system of claim 1 wherein the fuel control module:

determines a first target equivalence ratio for the cylinder;

when the intake and exhaust valves of the cylinder are activated after being deactivated for at least one combustion cycle of the cylinder, generates a second target equivalence ratio for the cylinder based on the first target equivalence ratio and the predetermined reactivation fueling adjustment set for the cylinder; and fuels the cylinder based on the second target equivalence ratio.

3. The engine control system of claim 2 wherein, when the intake and exhaust valves are activated after being activated for at least one combustion cycle of the cylinder, the fuel control module sets the second target equivalence ratio for the cylinder equal to the first target equivalence ratio.

4. A fueling adjustment determination system comprising:

the engine control system of claim 1; and an adjustment determination module that:

after a first deactivation of the intake and exhaust valves of the cylinder for at least one combustion cycle of the cylinder, activates the intake and exhaust valves of the cylinder;

adjusts fueling of the cylinder based on a first predetermined value;

determines a first amount of the at least one constituent of exhaust resulting from the adjustment based on the first predetermined value;

after a second deactivation of the intake and exhaust valves of the cylinder for at least one combustion cycle of the cylinder, activates the intake and exhaust valves of the cylinder;

adjusts fueling of the cylinder based on a second predetermined value;

determines a second amount of the at least one constituent of exhaust resulting from the adjustment based on the second predetermined value; and sets the predetermined reactivation fueling adjustment for the cylinder based on one of the first and second predetermined values.

5. The fueling adjustment determination system of claim 4 wherein the adjustment determination module further:

selects the one of the first and second predetermined values based on the first and second amounts of the at least one constituent of the exhaust; and sets the predetermined reactivation fueling adjustment for the cylinder based on the selected one of the first and second predetermined values.

6. The fueling adjustment determination system of claim 5 wherein the at least one constituent of the exhaust includes carbon dioxide, and wherein the adjustment determination module selects the first predetermined value when the first amount is greater than the second amount.

7. The fueling adjustment determination system of claim 6 wherein the adjustment determination module selects the second predetermined value when the second amount is greater than the first amount.

8. The fueling adjustment determination system of claim 5 wherein the at least one constituent of the exhaust includes carbon monoxide and oxygen, and wherein the adjustment determination module selects the first predetermined value when the first amount is less than the second amount.

9. The fueling adjustment determination system of claim 8 wherein the adjustment determination module selects the second predetermined value when the second amount is less than the first amount.

10. The fueling adjustment determination system of claim 5 wherein the adjustment determination module further:

after a third deactivation of the intake and exhaust valves of the cylinder for at least one combustion cycle of the cylinder, activates the intake and exhaust valves of the cylinder;

adjusts fueling of the cylinder based on a third predetermined value;

determines a third amount of the at least one constituent of exhaust resulting from the adjustment based on the third predetermined value;

selects the one of the first, second, and third predetermined values based on the first, second, and third amounts of the at least one constituent of the exhaust; and sets the predetermined reactivation fueling adjustment for the cylinder based on the selected one of the first, second, and third predetermined values.

11. An engine control method, comprising:

selectively activating and deactivating intake and exhaust valves of a cylinder of an engine;

disabling fueling of the cylinder when the intake and exhaust valves of the cylinder are deactivated;

activating the intake and exhaust valves of the cylinder after the intake and exhaust valves are deactivated for at least one combustion cycle of the cylinder; and when the intake and exhaust valves of the cylinder are activated after being deactivated for the at least one combustion cycle of the cylinder, adjusting fueling of the cylinder based on a predetermined reactivation fueling adjustment set for the cylinder based on at least one constituent of exhaust resulting from the adjustment based on the predetermined fueling adjustment.

12. The engine control method of claim 11 further comprising:

determining a first target equivalence ratio for the cylinder;

when the intake and exhaust valves of the cylinder are activated after being deactivated for the at least one combustion cycle of the cylinder, generating a second target equivalence ratio for the cylinder based on the first target equivalence ratio and the predetermined reactivation fueling adjustment set for the cylinder; and fueling the cylinder based on the second target equivalence ratio.

13. The engine control method of claim 12 further comprising, when the intake and exhaust valves are activated after being activated for the at least one combustion cycle of the cylinder, setting the second target equivalence ratio for the cylinder equal to the first target equivalence ratio.

14. The engine control method of claim 11 further comprising:

after a first deactivation of the intake and exhaust valves of the cylinder for at least one combustion cycle of the cylinder, activating the intake and exhaust valves of the cylinder;

adjusting fueling of the cylinder based on a first predetermined value;

determining a first amount of the at least one constituent of exhaust resulting from the adjustment based on the first predetermined value;

after a second deactivation of the intake and exhaust valves of the cylinder for at least one combustion cycle of the cylinder, activating the intake and exhaust valves of the cylinder;

adjusting fueling of the cylinder based on a second predetermined value;

determining a second amount of the at least one constituent of exhaust resulting from the adjustment based on the second predetermined value; and setting the predetermined reactivation fueling adjustment for the cylinder based on one of the first and second predetermined values.

15. The engine control method of claim 14 further comprising:

selecting the one of the first and second predetermined values based on the first and second amounts of the at least one constituent of the exhaust; and setting the predetermined reactivation fueling adjustment for the cylinder based on the selected one of the first and second predetermined values.

16. The engine control method of claim 15 wherein the at least one constituent of the exhaust includes carbon dioxide, and the engine control method further comprises:

selecting the first predetermined value when the first amount is greater than the second amount.

17. The engine control method of claim 16 further comprising selecting the second predetermined value when the second amount is greater than the first amount.

18. The engine control method of claim 15 wherein the at least one constituent of the exhaust includes carbon monoxide and oxygen, and the engine control method further comprises:

selecting the first predetermined value when the first amount is less than the second amount.

19. The engine control method of claim 18 further comprising selecting the second predetermined value when the second amount is less than the first amount.

20. The engine control method of claim 15 further comprising:

after a third deactivation of the intake and exhaust valves of the cylinder for at least one combustion cycle of the cylinder, activating the intake and exhaust valves of the cylinder;

adjusting fueling of the cylinder based on a third predetermined value;

determining a third amount of the at least one constituent of exhaust resulting from the adjustment based on the third predetermined value;

selecting the one of the first, second, and third predetermined values based on the first, second, and third amounts of the at least one constituent of the exhaust; and setting the predetermined reactivation fueling adjustment for the cylinder based on the selected one of the first, second, and third predetermined values.

* * * * *